US008857006B2

(12) United States Patent
Tanaka et al.

(10) Patent No.: US 8,857,006 B2
(45) Date of Patent: Oct. 14, 2014

(54) CLEANING IMPLEMENT AND CLEANING BODY

(75) Inventors: Yoshinori Tanaka, Kagawa-ken (JP); Masumi Fukuzawa, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 335 days.

(21) Appl. No.: 13/260,940

(22) PCT Filed: Mar. 31, 2010

(86) PCT No.: PCT/JP2010/055951

§ 371 (c)(1),
(2), (4) Date: Dec. 8, 2011

(87) PCT Pub. No.: WO2010/114072

PCT Pub. Date: Oct. 7, 2010

(65) Prior Publication Data

US 2012/0073075 A1 Mar. 29, 2012

(30) Foreign Application Priority Data

Mar. 31, 2009 (JP) ..... 2009-087496

(51) Int. Cl.

| | |
|---|---|
| ***A47L 13/12*** | (2006.01) |
| ***A47L 13/20*** | (2006.01) |
| ***A47L 13/38*** | (2006.01) |
| ***A47L 13/46*** | (2006.01) |

(52) U.S. Cl.

CPC *A47L 13/46* (2013.01); *A47L 13/38* (2013.01)
USPC ..... 15/229.3; 15/209.1; 15/226; 15/227; 15/229.1; 15/229.4

(58) Field of Classification Search

USPC ..... 15/209.1, 226, 227, 229.1, 229.3, 15/229.4, 229.7, 229.8
See application file for complete search history.

(56) References Cited

U.S. PATENT DOCUMENTS

| | | | | |
|---|---|---|---|---|
| 7,566,671 | B2 * | 7/2009 | Hoadley et al. | 442/381 |
| 7,870,635 | B2 * | 1/2011 | Yamada | 15/230 |

(Continued)

FOREIGN PATENT DOCUMENTS

| | | |
|---|---|---|
| JP | 3110306 | 6/2005 |
| JP | 2006212059 A | 8/2006 |

(Continued)

OTHER PUBLICATIONS

International Preliminary Report on Patentability corresponding to PCT/JP2010/055951, dated Nov. 24, 2011.

(Continued)

*Primary Examiner* — Randall Chin
(74) *Attorney, Agent, or Firm* — Lowe Hauptman & Ham LLP

(57) ABSTRACT

A cleaning tool has a cleaning element which includes a pair of right and left elongate split cleaning parts, each having an insert hole for receiving a holding element. A space is provided between the split cleaning parts for receiving an object to be cleaned. A third bonded part defines an outer side of the insert hole. The third bonded part includes a bonding line which extends straight in the longitudinal direction of the cleaning element in a front end region of the cleaning element, a bonding line which is formed rearward of the bonding line in the cleaning element and extends straight in the longitudinal direction of the cleaning element, and a bonding line which is formed rearward of the bonding line in the cleaning element and extends straight in the longitudinal direction of the cleaning element.

8 Claims, 15 Drawing Sheets

(56) References Cited

U.S. PATENT DOCUMENTS

| | | | | |
|---|---|---|---|---|
| 2007/0033761 | A1* | 2/2007 | Yang et al. | 15/226 |
| 2009/0255078 | A1 | 10/2009 | Wada et al. | |
| 2013/0340191 | A1* | 12/2013 | Przepasniak | 15/226 |

FOREIGN PATENT DOCUMENTS

| | | | |
|---|---|---|---|
| JP | 2007029136 | | 2/2007 |
| JP | 2007135774 | A | 6/2007 |
| JP | 2007136156 | | 6/2007 |

OTHER PUBLICATIONS

International Search Report and Written Opinion for PCT/JP2010/055951 mailed May 25, 2010.

Office Action mailed Mar. 12, 2014, corresponds to Japanese patent application No. 2011-507280.

* cited by examiner

CLEANING IMPLEMENT AND CLEANING BODY

RELATED APPLICATIONS

The present application is a national phase of PCT/JP2010/055951, filed on Mar. 31, 2010 and is based on, and claims priority from, Japanese Application Number 2009-087496, filed Mar. 31, 2009.

BACKGROUND OF THE INVENTION

1. Field of the Invention

The invention relates to a cleaning tool as a cleaning implement and a cleaning element as a cleaning body to clean an object to be cleaned.

2. Description of the Related Art

Japanese non-examined laid-open Patent Publication No. 2007-29136 discloses a cleaning tool having a cleaning element which includes a fabric layer and a scraping sheet. On the other hand, it is desired to enhance cleaning effect with respect to such cleaning tool and cleaning element.

SUMMARY OF THE INVENTION

Accordingly, it is an object of the invention to improve a cleaning tool and a cleaning element to clean an object to be cleaned.

The above-described object can be achieved by the claimed invention. According to the claimed invention, a representative cleaning tool to clean an object to be cleaned includes at least a cleaning element holder and a cleaning element.

With respect to the object to be cleaned, the representative cleaning tool can be applied to various regions including floors, walls, windows, ceilings, external walls, posts, furniture, clothes, curtains, blinds, bedding, lighting, electrical cords, home electric appliances and so on, to regions inside and outside of houses, apartments, buildings, factories, vehicles and so on, and to any regions of human body. These regions to be cleaned may be either flat or curved, uneven or stepped.

The cleaning element holder is provided as an elongate member. The cleaning element holder includes a grip held by a user and an elongate holding element extending from the grip. The cleaning element is designed as a member to be attached to the elongate cleaning element holder. This cleaning element includes at least a fiber assembly, a nonwoven fabric laminate, a bonded part and an insert region.

The fiber assembly is formed by a plurality of fibers extending in a direction transverse to the longitudinal direction of the cleaning element. Typically, the longitudinal direction of the cleaning element may be defined by an extending direction of a holding element in a state in which the cleaning element holder is attached to the cleaning element. The nonwoven fabric laminate is formed by a plurality of nonwoven fabric sheets. The bonded part is designed as bonded portions for bonding the fiber assembly and the nonwoven fabric laminate which are overlaid one on the other. The bonded part includes a bonded portion for bonding the fiber assembly in its entirety or in part, a bonded portion for bonding the nonwoven fabric laminate in its entirety or in part, and a bonded portion for bonding the fiber assembly in its entirety or in part and the nonwoven fabric laminate in its entirety or in part. The insert region is designed as a region which is defined by the plurality of nonwoven fabric sheets and the bonded part and receives the holding element. The insert region can be typically formed by an insert hole, a slit, a cut or the like into which the holding element can be inserted.

In the cleaning element of the invention, particularly, the bonded part has an outer bonded part which defines an outer side of the insert region in a direction transverse to the longitudinal direction of the cleaning element. The outer bonded part includes a plurality of bonded portions extending along the longitudinal direction of the cleaning element and disposed in positions displaced from each other in a direction transverse to the longitudinal direction of the cleaning element. As for this construction, the outer bonded part only needs to be a bonded part that defines the outer side of the insert region. This construction therefore includes a construction in which, in a cleaning element having a single insert region, the outer bonded part extends on the both sides of the insert region, and a construction in which, in a cleaning element having a plurality of insert regions which are disposed side by side, the outer bonded part extends on the outer sides of two of the insert regions which are disposed on opposite outer sides. Further, in this construction, the plurality of bonded portions of the outer bonded part which are disposed in positions displaced from each other in a direction transverse to the longitudinal direction of the cleaning element may be connected to each other, or may be separated from each other by non-bonded parts. Further, the plurality of bonded parts of the outer bonded part may extend in a curved line along the longitudinal direction of the cleaning element, or may extend in a stepped line along the longitudinal direction of the cleaning element.

With such a construction of the cleaning tool according to this invention, the effect of cleaning the object to be cleaned by the cleaning element can be enhanced. The fiber length or amount of the fiber assembly extending outward from the outer bonded part in the cleaning element in a direction transverse to the longitudinal direction of the cleaning element is made different from region to region by the bonded portions of the outer bonded part. In other words, the plurality of bonded portions of the outer bonded part are designed as a means for adjusting the fiber length or amount of the fiber assembly extending in the direction transverse to the longitudinal direction of the cleaning element. Thus, the cleaning element can take a suitable form for desired cleaning.

Further, the cleaning element of the cleaning tool according to this invention may be of disposable type designed for single use, disposable type designed for multiple use which can be used several times, while holding dust or dirt which has been removed from the object to be cleaned, on a brush portion, or reusable type which can be reused by washing.

In a further embodiment of the cleaning tool according to this invention, the bonded portions of the outer bonded part of the cleaning element preferably include a first bonding line and a second bonding line. The first bonding line is formed in a front end region of the cleaning element in which a front end of the holding element is placed when the cleaning element holder is attached to the cleaning element, and extends straight in the longitudinal direction of the cleaning element, and the second bonding line is formed rearward of the first bonding line in the cleaning element and extends straight in the longitudinal direction of the cleaning element. The first bonding line is disposed inward of the second bonding line, preferably in a direction transverse to the longitudinal direction of the cleaning element.

With such a construction, the outer bonded part formed by the first and second bonding lines is bulged outward from the front end region toward the rear end region of the cleaning element. Therefore, in the cleaning element, the fiber length or amount of the fiber assembly extending outward from the outer bonded part in the direction transverse to the longitudinal direction of the cleaning element is larger in a region in which the first bonding line is formed than in a region in which the second bonding line is formed.

In a further embodiment of the cleaning tool according to this invention, preferably, the bonded portions of the outer bonded part in the cleaning element include a third bonding line which is formed rearward of the second bonding line in the cleaning element and extends straight in the longitudinal direction of the cleaning element. The third bonding line is disposed inward of the second bonding line in the direction transverse to the longitudinal direction of the cleaning element.

With such a construction, in the cleaning element, the fiber length or amount of the fiber assembly extending outward from the outer bonded part in the direction transverse to the longitudinal direction of the cleaning element is larger in regions in which the first and third bonding lines are formed than in a region in which the second bonding line is formed. Further, in this construction, the bonded part including the first, second and third bonding lines is formed in an outwardly bulged gentle curve, so that the cleaning element has a rounded shape as a whole. The cleaning element having such a rounded shape as a whole makes a soft impression on the users, and the users can be emotionally convinced that the shape of the cleaning element is suitable for cleaning operation or ensures an easy cleaning operation. As a result, the user's motivation for cleaning can be effectively enhanced.

In a further embodiment of the cleaning tool according to this invention, preferably, the first bonding line is connected to the second bonding line by a bonding line connected to the first and second bonding lines, and the third bonding line is connected to the second bonding line by a bonding line connected to the second and third bonding lines. With this construction, a single bonding line extending continuously through the first, second and third bonding lines of the cleaning element is formed, so that the process of forming the bonding line can be simplified.

In a further embodiment of the cleaning tool according to this invention, preferably, the cleaning element holder has a plurality of the elongate holding elements extending side by side from the grip. As for the manner of extending "side by side" herein, it is only necessary for the holding elements to be disposed side by side, and it includes the manner in which a plurality of the holding elements are disposed in parallel, and the manner in which the distance between two adjacent holding elements is decreased toward the front end. Further, preferably, the cleaning element has a space which extends in the longitudinal direction of the cleaning element and into which the object to be cleaned can be inserted. Further, the cleaning element is split into a plurality of split cleaning parts by the space and each of the split cleaning parts has the bonded part and the insert region. By insertion of the object to be cleaned into the space, the object to be cleaned is cleaned while being held between the split cleaning parts. Further, the manner of being "split" here widely includes the manner in which a predetermined split cleaning part is separated in its entirety or in part from the other split cleaning part by a space, and the manner in which a predetermined split cleaning part is integrally connected to the other split cleaning part.

With such a construction, in each of the split cleaning parts of the cleaning element, the fiber length or amount of the fiber assembly extending outward and inward from the outer bonded part in the direction transverse to the longitudinal direction of the cleaning element is made different from region to region by the bonded portions of the outer bonded part, so that the cleaning element can take a suitable form for desired cleaning.

As one aspect of the invention, a cleaning element may be independently provided in which the cleaning element may substantially have the same construction as the above-described cleaning element as a part of the cleaning tool. Therefore, in the cleaning element having such a construction, the fiber length or amount of the fiber assembly extending outward from the outer bonded part in the direction transverse to the longitudinal direction of the cleaning element is made different from region to region by the bonded portions of the outer bonded part, so that the cleaning element can take a suitable form for desired cleaning.

As for the plurality of bonded portions of the outer bonded part, by provision of a first bonding line disposed inward of a second bonding line, preferably in a direction transverse to the longitudinal direction of the cleaning element, the fiber length or amount of the fiber assembly extending outward from the outer bonded part in the direction transverse to the longitudinal direction of the cleaning element is made larger in a region in which the first bonding line is formed than in a region in which the second bonding line is formed. Further, by provision of a third bonding line disposed inward of the second bonding line in the direction transverse to the longitudinal direction of the cleaning element, the fiber length or amount of the fiber assembly extending outward from the outer bonded part in the direction transverse to the longitudinal direction of the cleaning element is made larger in the regions in which the first and third bonding lines are formed than in the region in which the second bonding line is formed.

Further, with the construction in which the first bonding line is connected to the second bonding line by a bonding line connected to the first and second bonding lines, and the third bonding line is connected to the second bonding line by a bonding line connected to the second and third bonding lines, a single bonding line extending continuously through the first, second and third bonding lines of the cleaning element is formed, so that the process of forming the bonding line can be simplified.

Further, in the cleaning element having a space into which the object to be cleaned can be inserted and a plurality of split cleaning parts formed by splitting the cleaning element by the space, the fiber length or amount of the fiber assembly extending outward from the outer bonded part in the direction transverse to the longitudinal direction of the cleaning element is made different from region to region by the bonded portions of the outer bonded part, so that the cleaning element can take a suitable form for desired cleaning.

Effect of the Invention

Accordingly to the invention, an improved cleaning tool and a cleaning element to clean an object to be cleaned are provided. Other objects, features and advantages of the present invention will be readily understood after reading the following detailed description together with the accompanying drawings and the claims.

DETAILED DESCRIPTION OF THE INVENTION

A structure of a cleaning tool 100 as one embodiment of a "cleaning tool" according to the invention is now explained with reference to the drawings. The cleaning tool 100 is configured as the cleaning tool which is used for cleaning an object to be cleaned. Objects to be cleaned typically include regions to be cleaned (floors, walls, windows, ceilings, external walls, posts, furniture, clothes, curtains, blinds, bedding, lighting, electrical cords, home electric appliances, etc.) inside and outside of houses, apartments, buildings, factories, vehicles (motor vehicles), etc. and regions of human body parts to be cleaned. These regions to be cleaned may be either flat or curved, uneven or stepped.

Figure 1:
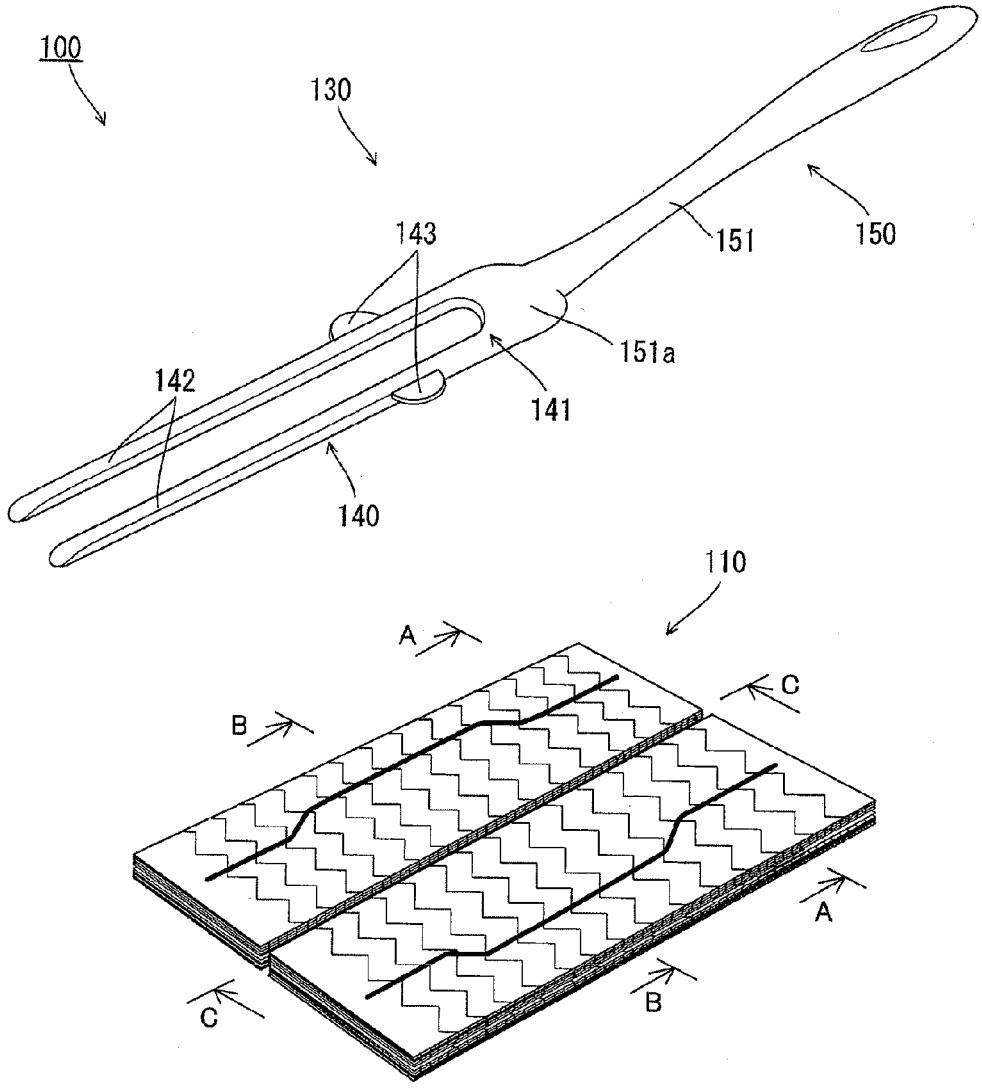
FIG. 1 is a perspective view showing a cleaning element 110 and a cleaning element holder 130 that form a cleaning tool 100 according to an embodiment of the invention, in a state in which they are not yet attached to each other.

FIG. 1 shows the cleaning tool 100 according to this embodiment in perspective view, in a state disassembled into a cleaning element 110 and a cleaning element holder 120. As shown in FIG. 1, the cleaning tool 100 comprises the cleaning element 110 (which is also referred to as a "mop") and the cleaning element holder 130.

The cleaning element 110 has a function of wiping, sweeping or scraping dust, dirt or contamination on a region to be cleaned (hereinafter also referred to as "object to be removed") on an object to be cleaned. The cleaning element 110 is in a sheet-like or plate-like form at the time of purchase or in initial unused state, and in use, it is loosened such that its volume is increased in the direction of the sheet thickness. As shown in FIG. 1, the cleaning element 110 has a rectangular sheet in plan view, extending in a predetermined longitudinal direction (the direction of the length), and has a layered structure in which a plurality of sheets (a cleaning element sheet part 116 and a holding sheet part 112 which are described below) having the same planar shape are overlaid one on the other, which will be explained in more detail below. The cleaning element 110 herein is a feature that corresponds to the "cleaning element" according to this invention.

Further, the cleaning element 110 may also have a square or other shape in plan view as necessary. The cleaning element 110 having a rectangular or square shape in plan view is designed such that its corners are right-angled or rounded as necessary. The cleaning element 110 may be of disposable type designed for single use, disposable type designed for multiple use which can be used several times, while holding the object to be removed which has been removed from the region to be cleaned, on the brush portion, or reusable type which can be reused by washing.

The cleaning element holder 130 is removably attached to the cleaning element 110 constructed as described above. The cleaning element holder 130 is an elongate member including the holder body 140 and the handle 150 connected to each other. The cleaning element holder 130 herein is a feature that corresponds to the "cleaning element holder" according to this invention. The handle 150 includes a handle body 151 extending in an elongate form and a connection 151*a* disposed between the handle body 151 and the holder body 140. The handle body 151 is a part to be held by a user. The handle body 151 and the holder body 140 are fixedly connected at the connection 151*a*. An appropriate structure of the cleaning element holder 130 to be used here includes a structure in which the holder body 140 and the handle 150 (the handle body 151 and the connection 151*a*) are separately formed and designed to be fixedly connected together, a structure in which the holder body 140 and the handle 150 are integrally formed together with the connection 151*a*, a structure in which two of the holder body 140, the handle 150 and the connection 151*a* are integrally formed. The handle 150 and the handle body 151 herein form the "grip" according to this invention.

The holder body 140 has a function of detachably holding the cleaning element 110. The holder body 140 includes a pair of right and left holding elements 142 which are formed on a base 141 of the handle 150. The pair of right and left holding elements 142 herein are disposed side by side in a lateral direction transverse to the longitudinal direction of the handle 150 when the longitudinal direction of the handle 150 is defined as a longitudinal direction of the cleaning tool.

The right and left holding elements 142 extend forward in the longitudinal direction from the base 141 and in parallel (side by side) with a predetermined spacing therebetween on the same plane. Further, typically, the holding elements 142 are configured as rod-like or plate-like parts having a circular, elliptical, triangular or rectangular section. In other words, the holder body 140 has a bifurcated form. Each of the holding elements 142 typically has a constant width in the longitudinal direction or is tapered. Each of the holding elements 142 has a protruding piece 143 protruding outward from the outer edge of the holding element 142. One or more protruding pieces 143 are preferably provided in the longitudinal direction of the holding element 142. With this construction, a region of the holding element 142 which has the protruding piece 143 forms a large-width portion having the largest extent in the lateral direction. The holding elements 142 herein form the "holding element" according to this invention. As for the sectional shape of the holding elements 142, rectangular, square, circular or polygonal shape can be appropriately used.

Further, in this specification, the longitudinal direction of the holding elements 142 is defined as the "longitudinal direction of the cleaning element" with respect to the cleaning tool 100 and the cleaning element 110, and the direction of parallel placement of the pair holding elements 142 or the direction transverse to the longitudinal direction of the holding elements 142 is defined as the "lateral direction of the cleaning element" with respect to the cleaning tool 100 and the cleaning element 110. Further, a region of the cleaning element 110 in which a front end of the holding element 142 is placed when the cleaning element is attached to the cleaning element holder is defined as the "front end region of the cleaning element" or the "front of the cleaning element", and a region of the cleaning element 110 in which a proximal end of the holding element 142 is placed is defined as the "rear end region of the cleaning element" or the "rear of the cleaning element".

Each of the holding plates 142 can be inserted into an associated insert region (an insert hole 115 which is described below) formed in the cleaning element 110 and has a function of holding the cleaning element 110 in the inserted state. In the inserted state, the holding elements 142 are fitted in the insert region of the cleaning element 110 by close sliding contact, so that the cleaning element 110 is securely attached to the holding elements 142. Further, in the inserted state, the large-width portions or the protruding pieces 143 of the holding elements 142 serve as a stopper for preventing the cleaning element 110 from coming off. With this construction, in the inserted state in which each of the holding elements 142 is inserted into the insert region of the cleaning element 110, the cleaning element 110 is reliably retained as being prevented from coming off by the holder body 140.

Figure 2:
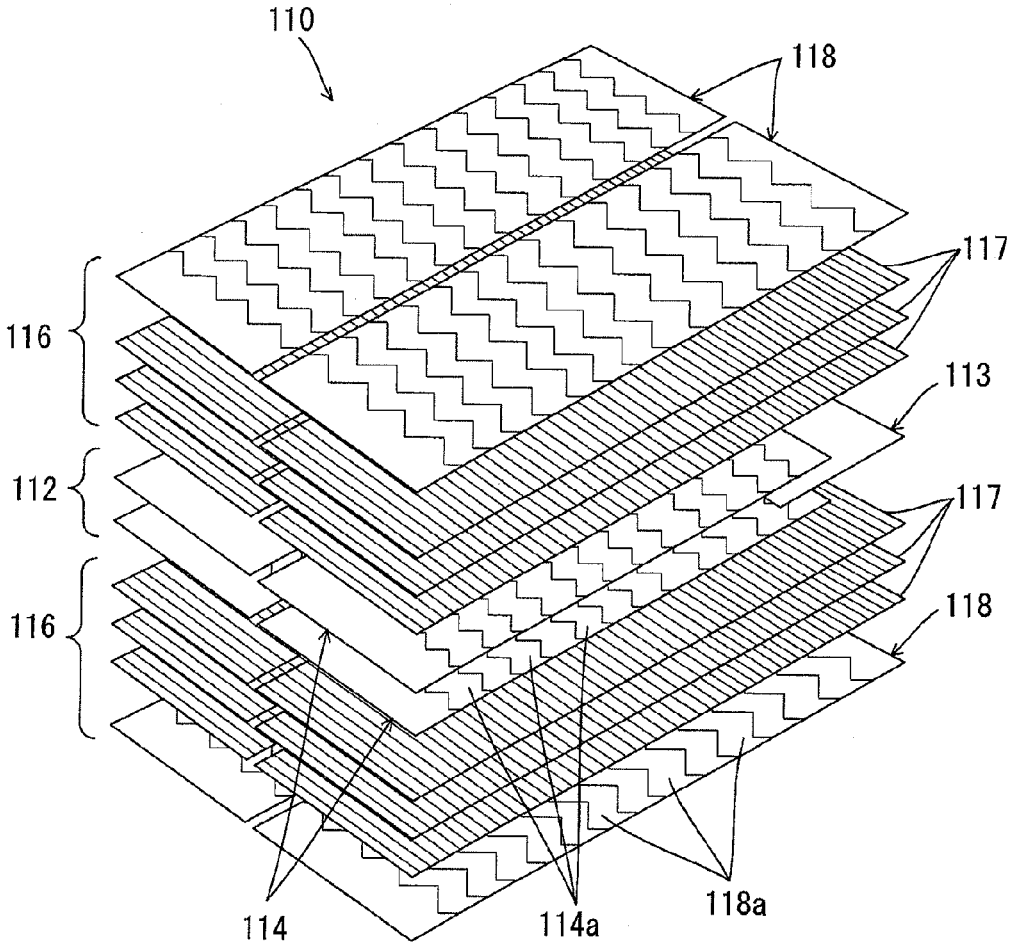
FIG. 2 is a perspective view of the cleaning element 110 in FIG. 1, in a state separated into elements of a layered structure.
Figure 3:
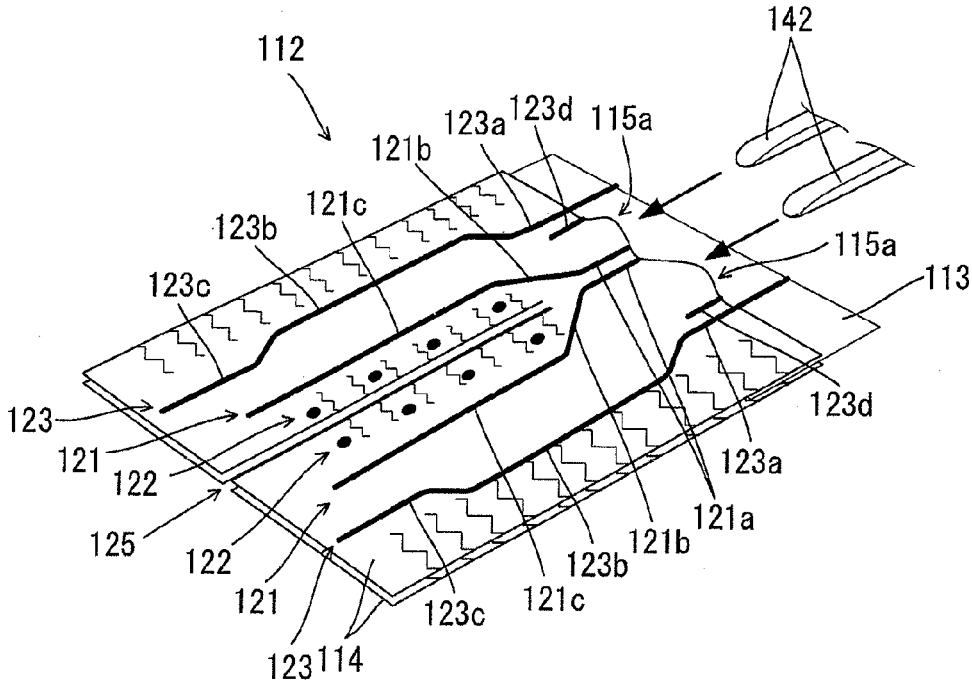
FIG. 3 is a perspective view showing a holding sheet part 112 of the cleaning element 110 in FIG. 1.
Figure 4:
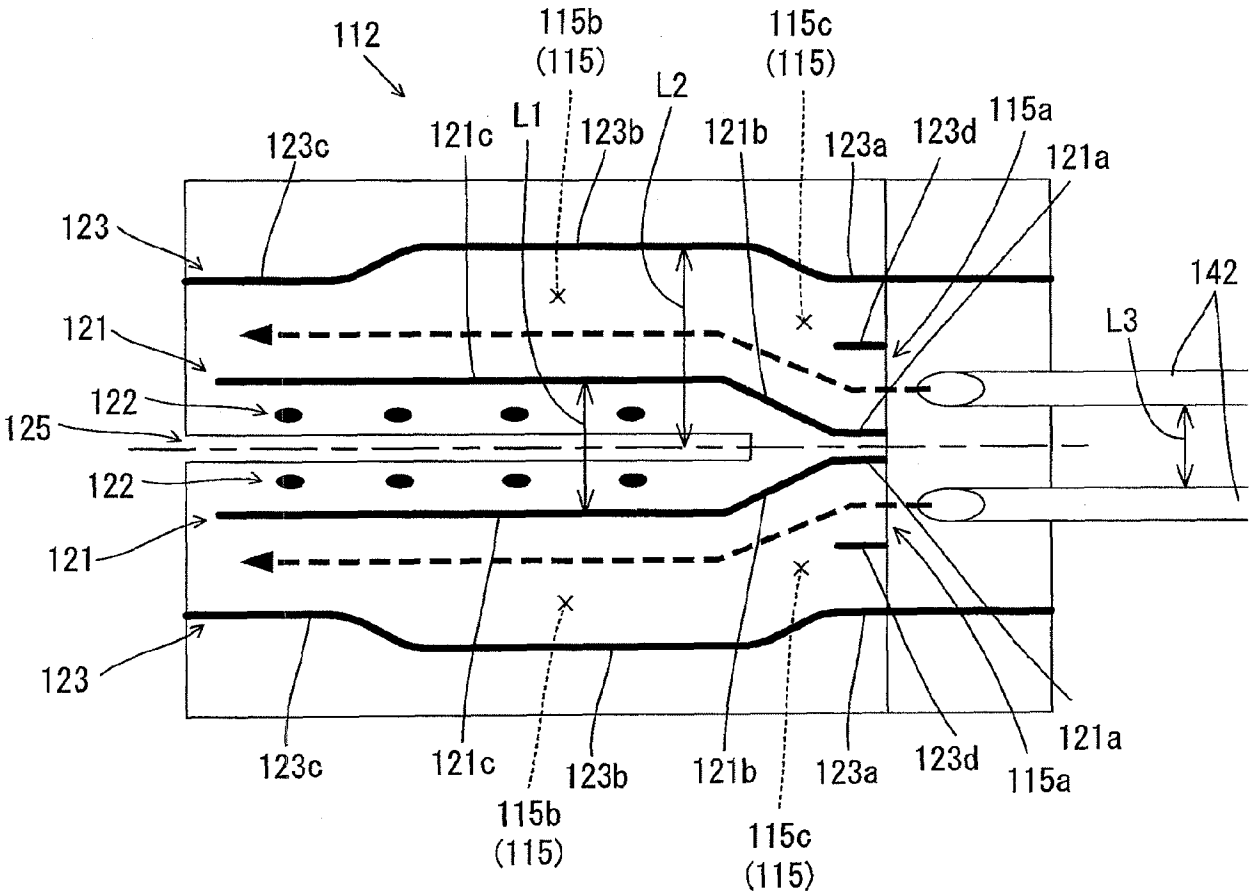
FIG. 4 is a plan view showing the holding sheet part 112 in FIG. 3.

The specific structure of the above-described cleaning element 110 is now explained in more detail with reference to FIGS. 2 to 7 in addition to FIG. 1. FIG. 2 is a perspective view of the cleaning element 110 of FIG. 1 which is shown separated into elements of a layered structure, and FIG. 3 is a perspective view of a holding sheet part 112 of the cleaning element 110 in FIG. 1. FIG. 4 is a plan view of the holding sheet part 112 in FIG. 3. Further, FIG. 5 is a sectional view of the cleaning element 110, taken along line A-A in FIG. 1, FIG. 6 is a sectional view of the cleaning element 110, taken along line B-B in FIG. 1, and FIG. 7 is a sectional view of the cleaning element 110, taken along line C-C in FIG. 1.

As shown in FIG. 2, in the cleaning element 110 of this embodiment, the cleaning element sheet parts 116 are overlaid on both sides of the holding sheet part 112. As shown in FIGS. 3 and 4, the cleaning element 110 has a slit-like space 125 extending in the longitudinal direction of the cleaning element. The space 125 is typically configured as a cut formed by cutting the holding sheet part 112 in its center in a straight, curved or wiggly line in the longitudinal direction of the cleaning element. The space 125 herein is a feature that corresponds to the "space" according to the invention. The space 125 typically extends in a straight, curved or wiggly line in the longitudinal direction of the cleaning element.

Figure 5:
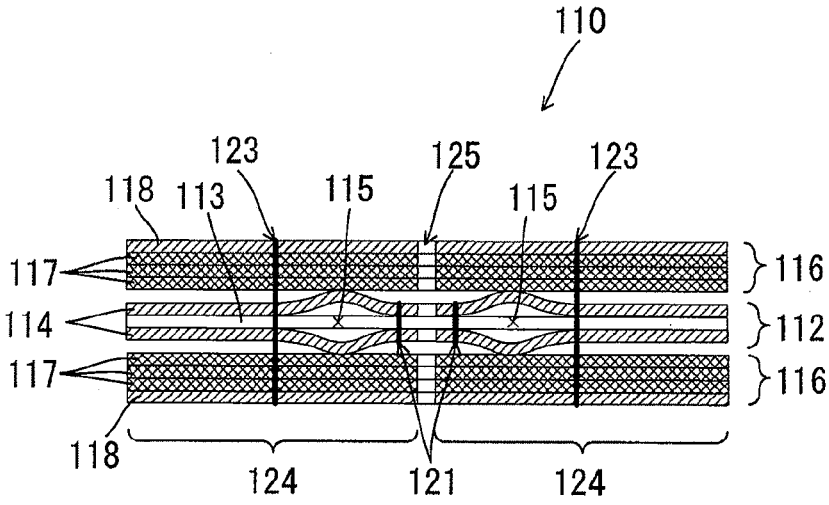
FIG. 5 is a sectional view of the cleaning element 110, taken along line A-A in FIG. 1.
Figure 6:
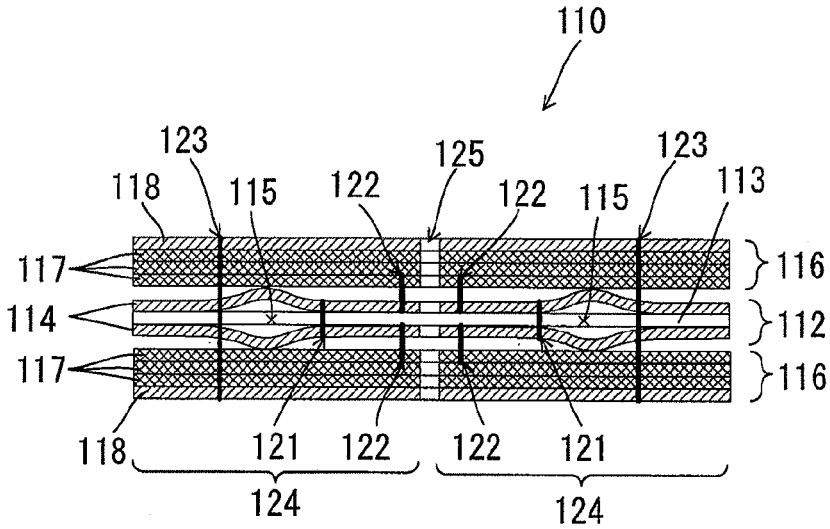
FIG. 6 is a sectional view of the cleaning element 110, taken along line B-B in FIG. 1.
Figure 7:
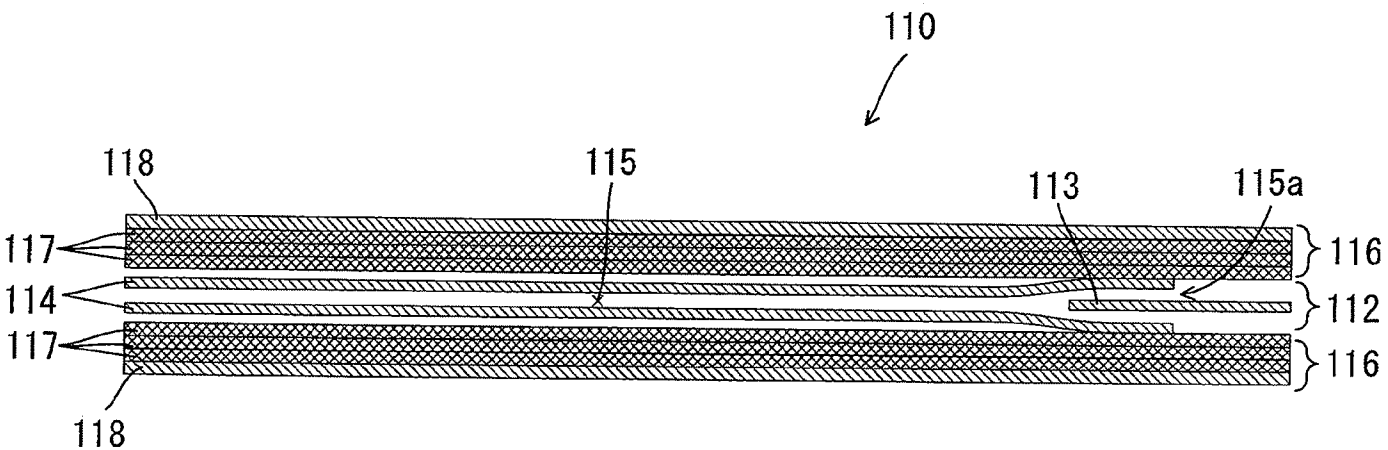
FIG. 7 is a sectional view of the cleaning element 110, taken along line C-C in FIG. 1.

Further, as shown in FIGS. 5 and 6, the cleaning element 110 is split into a pair of right and left elongate split cleaning parts 124 by the space 125. The pair of right and left split cleaning parts 124 herein are disposed side by side in the lateral direction transverse to the longitudinal direction of the cleaning element. The space 125 formed between the split cleaning parts 124 serves as a space into which the objects to be cleaned can be inserted, which will be explained in more detail below.

Particularly, as shown in FIG. 3, in the holding sheet part 112, a base sheet 113 is disposed between two holding sheets 114 and the base sheet 113 slightly protrudes from the holding sheets 114 on the side of insertion of the holding elements 142. In this state, as shown in FIGS. 5 and 6, in each of the split cleaning parts 124, the holding sheet part 112 is fusion-bonded together via a first bonded part 121 (which is also referred to as the "fusion-bonded part"). The first bonded part 121 is configured as a single bonding line (which is also referred to as the "fusion bonding line") in which a fusion-bonded portion of the first bonded part 121 continuously extends along the longitudinal direction of the cleaning element. A space defined by the pair holding sheets 114 opposed to each other in the holding sheet part 112 is configured as an insert space in the form of the insert hole 115 extending in the longitudinal direction of the split cleaning parts 124 in order to allow insertion of the holding elements 142. At this time, the base sheet 113 which protrudes from the holding sheets 114 to the side of insertion of the holding elements 142 can smoothly guide the holding plates 142 into an opening 115*a* of the insert hole 115. The longitudinal direction of the split cleaning parts 124 is typically also defined as the extending direction of the holding elements 142 in a state in which the cleaning element holder 130 is attached to the cleaning element 110. The insert hole 115 herein is a feature that corresponds to the "insert region" according to this invention. Any insert region, such as a slit and a cut, into which the holding element can be inserted may also be used in place of the insert hole 115.

As shown in FIG. 2, each of the cleaning element sheet parts 116 includes three fiber assemblies 117 and a front sheet 118 which are stacked in layer, and in this state, the cleaning element sheet parts 116 are arranged on both sides (upper and lower sides) of the holding sheet part 112. At this time, the cleaning element sheet parts 116 are arranged such that the front sheet 118 is exposed on the surface of the cleaning element 110. Further, the cleaning element sheet part 116 may be disposed on only one side of the holding sheet part 112 as necessary.

Further, one of the three fiber assemblies 117 of the cleaning element part 116 which faces the holding sheet part 112 is fusion bonded to the holding sheet part 112 by a second bonded part 122 shown in FIGS. 3, 4 and 6. The second bonded part 122 is configured as an assembly of bonding points (also referred to as the "fusion-bonding points") which discontinuously extend along the longitudinal direction of the cleaning element.

Further, the holding sheet part 112 and the cleaning element sheet parts 116 which are described above are fusion-bonded together via a third bonded part 123 in the state in which the cleaning element sheet parts 116 are overlaid on the both sides of the holding sheet part 112. The third bonded part 123 is configured as an assembly of a plurality of bonding lines (also referred to as the "fusion-bonding lines") which continuously extend along the longitudinal direction of the cleaning element.

In this embodiment, the first to third bonded parts 121, 122, 123 constructed as described above have at least three functions by fusion bonding. The first function (hereinafter also referred to as the "first function of the bonded part") is to form the insert hole 115 into which the holding elements 142 can be inserted in a desired manner between the pair holding sheets 114. The second function (hereinafter also referred to as the "second function of the bonded part") is to bond the holding sheet part 112 and the cleaning element sheet parts 116 together to thereby form a brush portion having a desired shape formed by the cleaning element sheet parts 116 on the holding sheet part 112. The third function (hereinafter also referred to as the "third function of the bonded part") is to bond the holding sheet part 112 and a part of the fiber assemblies 117 of the cleaning element sheet part 116 together to thereby avoid free ends of the fiber assemblies 117 from being separated too far away from the holding sheet part 112. Further, as for the manner of bonding the first to third bonded parts 121, 122, 123, alternatively or in addition to fusion bonding, gluing, fastening, seaming or other bonding manners may be used.

Here, the first to third functions by the first to third bonded parts 121, 122, 123 are described in more detail with reference to FIGS. 3 and 4.

(First Function of Bonded Part)

As shown in FIGS. 3 and 4, the first function of the bonded part can be realized by the construction in which the first bonded part 121 and the third bonded part 123 of this embodiment define the right and left sides of the insert hole 115 extending in the longitudinal direction of the split cleaning part 124.

Specifically, the first bonded part 121 is designed as a bonded part which defines the inner side (the space 125 side) of the insert hole 115 and extends in the longitudinal direction of the cleaning element 110 (in the longitudinal direction of the split cleaning part 124). The first bonded part 121 includes a bonding line 121*a*, a bonding line 121*b* and a bonding line 121*c* which are arranged in this order from an opening 115*a* side of the insert hole 115 toward the front end of the cleaning element 110 and connected to each other. In other words, in the first bonded part 121, a single extending line is continuously formed by the bonding lines 121*a*, 121*b*, 121*c*. The bonding lines 121*a*, 121*c* extend straight substantially in the same direction as the direction of insertion of the holding element 142 into the insert hole 115, and the bonding line 121*c* is disposed outward of the bonding line 121*a* (on the side opposite to the space 125). The bonding line 121*b* is configured as an intermediate bonding line which is obliquely formed between the bonding line 121*a* and the bonding line 121*c* so as to connect associated ends of the bonding lines 121*a*, 121*c*.

The third bonded part 123 is designed as a bonded part which defines the side of the insert hole 115 opposite to the first bonded part 121 and extends along the longitudinal direction of the cleaning element 110 (the longitudinal direction of the split cleaning part 124). The third bonded part 123 includes bonding lines 123*a*, 123*b*, 123*c* which are arranged in this order from the opening 115*a* side toward the front end of the cleaning element 110, and a bonding line 123*d* disposed inward of the bonding line 123*a*. In this embodiment, the bonding lines 123*a*, 123*b*, 123*c* of the third bonded part 123 form a continuous single extending line. Further, the bonding lines 123*a*, 123*b*, 123*c* may be separated from each other by non-bonded parts formed therebetween, and/or the bonding line 123*d* may be omitted.

Further, in this embodiment, a predetermined relationship is preferably realized in the spacing between the first bonded parts 121 and the third bonded parts 123 which are constructed as described above. Specifically, as shown in FIG. 4, the right and left first bonded parts 121 on the opposite sides of the space 125 are preferably designed such that a distance L1 between the bonding lines 121*c* of the first bonded parts 121 is longer than a distance L3 between the right and left holding elements 142 (L1>L3). It is particularly preferred that the distance L1 is set to be 175% to 300% of the distance L3. The distance L1 between the right and left first bonded parts 121 each of which defines the inner side of the associated insert hole 115 is also defined as a distance between the adjacent insert holes 115. In this case, the insert hole 115 includes a first insert hole component 115*b* extending along a region (a widely spaced part) of the insert hole 115 which extends along the first bonded parts 121, the opening 115*a* and an obliquely extending second insert hole component 115*c* which is connected between the first insert hole component 115*b* and the opening 115*a*.

With such arrangement, when the holding elements 142 of the cleaning element holder 130 are inserted into the insert holes 115 of the cleaning element 110, the entire cleaning element 110 (the holding sheet part 112 and the cleaning element sheet parts 116) is gathered toward the inward or center of the cleaning element according to the distance L3 between the holding elements 142. Then the fiber assemblies of the split cleaning parts 124 which are adjacent to each other in the region (the widely spaced part) extending along the right and left first bonded parts 121 move toward each other and overlap each other in a direction transverse to the longitudinal direction of the split cleaning parts 124 in the space 125, so that an overlap region 119 which is described below is formed. As a result, the volume of the cleaning element 110 can be increased to a desired extent by the split cleaning parts 124. Therefore, even if the object to be cleaned which is inserted into the space 125 between the split cleaning parts 124 is relatively small, a sufficient cleaning effect can be obtained by applying an appropriate pressure to the object to be cleaned.

In order to further ensure such a cleaning effect, it is preferred that the pair holding elements 142 of the holder body 140 which are constructed as described above are formed of an elastic material which can deform at least in a direction in which the pair holding elements are spaced apart from each other, or typically a plastic material having both flexibility and shape retaining function. With such construction, the entire cleaning element 110 is reliably gathered toward the inward or center of the cleaning element by its shape retaining function of the holding elements 142, and the object to be cleaned which is inserted into the space 125 is reliably cleaned due to flexibility of the holding elements 142.

Further, with the construction in which the holding elements 142 of the cleaning element holder 130 are made of non-metallic material, even if the insertion width of the object to be cleaned which is inserted into the space 125 between the split cleaning parts 124 is longer than the distance between the holding elements 142, a sufficient cleaning effect can be obtained without damaging the object to be cleaned by the holding elements 142.

Further, in this embodiment, preferably, the relationship between the distance L1 and the distance L3 is designed to be L1>L3, and their relationship with a distance L2 between a center line (an extending line of the space 125) in the longitudinal direction of the cleaning element and the third bonded part 123 is designed to be (L1/2−L3/2)<L2. Such configuration is designed such that an inner edge (an edge on the space 125 side) of one of the split cleaning parts 124 is not gathered over the third bonded part 123 of the other split cleaning part 124, when the holding elements 142 of the cleaning element holder 130 are inserted into the insert hole 115 of the cleaning element 110.

Therefore, such configuration is effective for preventing the cleaning element 110 from excessively increasing in volume and preventing the brush portion of the split cleaning parts 124 (the holding sheet part 112 and the cleaning element sheet parts 116) from becoming entangled too much with each other to provide a suitable form for cleaning.

(Second Function of Bonded Part)

Further, as shown in FIGS. 3 and 4, in this embodiment, the second function of the bonded part can be realized by the construction in which the bonding lines 123*a*, 123*b*, 123*c* of the third bonded part 123 formed as the single extending line are arranged to be stepped with respect to each other.

Specifically, the third bonded part 123 includes the bonding line 123*c* which extends straight in the longitudinal direction of the split cleaning parts 124 in the front end region of the cleaning element in which the front end of the holding element 142 is placed when the cleaning element holder is attached to the cleaning element, the bonding line 123*b* which is disposed rearward of the bonding line 123*c* in the cleaning element and extends straight in the longitudinal direction of the split cleaning part 124, and the bonding line 123*a* which is disposed rearward of the bonding line 123*b* in the cleaning element and extends straight in the longitudinal direction of the split cleaning part 124. Then the bonding line 123*b* formed between the bonding line 123*a* and the bonding line 123*c* is disposed outward of the bonding lines 123*a* and 123*c* (on the side opposite to the space 125) in the cleaning element. Further, in the third bonded part 123, inclined bonded parts each are disposed between the bonding line 123*a* and the bonding line 123*b* and between the bonding line 123*b* and the bonding line 123*c*.

Further, the third bonded part 123 herein is designed as an outer bonded part which defines an outer side of the insert hole 115 in a direction transverse to the longitudinal direction of the cleaning element 110, and the third bonded part 123 is a feature that corresponds to the "outer bonded part" according to the invention. Further, the bonded lines 123*a* to 123*c* forming the third bonded part 123 form the "plurality of bonded portions" according to the invention. The bonding line 123*a*, the bonding line 123*b* and the bonding line 123*c* are features that correspond to the "third bonding line", the "second bonding line" and the "first bonding line", respectively, according to the invention.

With such construction, the distance from the third bonded part 123 to outer free ends of the holding sheet part 112 and the cleaning element sheet parts 116 is longer in the front and the rear of the cleaning element than in the middle of the cleaning element in the longitudinal direction of the cleaning element. Thus, when the holding element 142 of the cleaning element holder 130 is inserted into the insert hole 115 of the cleaning element 110, a contiguous contour of the third bonded part 123 which is formed by the bonding lines 123*a*, 123*b*, 123*c* is formed in an outwardly bulged gentle curve, so that the cleaning element has a rounded shape as a whole. The cleaning element having such a rounded shape as a whole makes a soft impression on the users, and the users are emotionally convinced that the shape of the cleaning element is suitable for cleaning operation or ensures an easy cleaning operation. As a result, the user's motivation for cleaning can be effectively enhanced.

Further, by provision of the third bonded part 123 constructed as described above, the length of the fiber assemblies extending outward from the third bonded part 123 of each of the split cleaning parts 124 in the cleaning element is longer in the rear of the cleaning element in which the bonding line 123*a* is formed and in the front of the cleaning element in which the bonding line 123*c* is formed than in the middle of the cleaning element in which the bonding line 123*b* is formed. On the other hand, the length of the fiber assemblies extending inward from the third bonded parts 123 of each of the split cleaning parts 124 in the cleaning element is shorter in the rear of the cleaning element in which the bonding line 123*a* is formed and in the front of the cleaning element in which the bonding line 123*c* is formed than in the middle of the cleaning element in which the bonding line 123*b* is formed.

With such arrangement, corners of the front or rear end of the cleaning element in which the length of the fiber assemblies is relatively long come in soft contact with the object to be cleaned. Further, due to the relatively short length of the fiber assemblies extending inward in the front of the cleaning element, the object to be cleaned can be easily inserted into the space 125 between the split cleaning parts 124 (the object can be easily caught in the space 125).

Further, in this embodiment, a predetermined relationship is preferably realized between the lengths of the bonding lines in the third bonded part 123 constructed as described above. Typically, the bonding lines 123*a* and 123*c* are designed to extend in the range of 15% to 30% of the longitudinal length of the split cleaning part 124 from the rear end and the front end of the cleaning element, respectively. Further, the bonding line 123*a* and the bonding line 123*b*, or the bonding line 123*c* and the bonding line 123*b* may be designed to overlap each other in a direction transverse to the longitudinal direction of the split cleaning part 124.

(Third Function of Bonded Part)

Further, as shown in FIGS. 3 and 4, in this embodiment, the third function of the bonded part can be realized by the construction in which the holding sheet part 112 and a part of the fiber assemblies 117 of the cleaning element sheet part 116 are bonded together by the second bonded part 122.

Specifically, the second bonded part 122 is designed as a bonded part provided on the side (inward in the cleaning element) of the first bonded part 121 opposite to the insert hole 115 in the direction transverse to the longitudinal direction of the split cleaning part 124 (the longitudinal direction of the cleaning element) and dotted with a plurality of bonding points in the longitudinal direction of the cleaning element. In this construction, the first bonded part 121 defines the space 125 side of the insert hole 115, and the second bonded part 122 is disposed closer than the first bonded part 121 to the space 125 in the split cleaning part 124. At the bonding points of the second bonded part 122, the holding sheet part 112 and the fiber assembly 117 facing the holding sheet part 112 are partly bonded together. The second bonded part 122 may be formed by one or more bonding points as necessary.

With such a construction, particularly during a cleaning operation in which the object to be cleaned is inserted into the space 125, the fiber assembly 117 in an inner portion of the cleaning element is anchored by the second bonded part 122 in order to be prevented from being excessively turned up, so that the cleaning effect can be enhanced. Further, reduction of the amount of the fiber assembly 117 that comes into contact with the object to be cleaned which is inserted into the space 125 between the split cleaning parts 124 is avoided to maintain the effect of interference with the object to be cleaned. As a result, damage or other adverse effects of the holding elements 142 of the cleaning element holder 130 on the object to be cleaned can be avoided. Moreover, contact noise which is caused by contact between the holding elements 142 of the cleaning element holder 130 and the object to be cleaned via the fiber assembly 117 can be kept pleasant.

Such a third function of the bonded part which is performed by the second bonded part 122 can be realized not only by the construction in which the holding sheet part 112 and the fiber assemblies 117 of the cleaning element sheet part 116 are bonded together, but by the construction in which a portion of the holding sheet part 112 that faces the space 125 is cut into strips in a direction transverse to the longitudinal direction of the split cleaning part 124 (the longitudinal direction of the cleaning element) and the strips are provided with rigidity in materials so as to produce the above-described effect of interference.

Further, the second bonded part 122 constructed as described above may also be disposed on the side of the third bonded part 123 opposite to the insert hole 115 in a direction transverse to the longitudinal direction of the split cleaning part 124, or outward of the third bonded part 123 in the cleaning element. In this case, particularly during a cleaning operation in which the object to be cleaned is cleaned by using an outer portion of the split cleaning part 124, the fiber assembly 117 in an outer portion of the cleaning element is anchored by the second bonded part 122 in order to be prevented from being excessively turned up, so that the effect of cleaning the object to be cleaned can be enhanced.

Preferably, each of the holding sheets 114 and the front sheets 118 which are described above has a plurality of zigzag strips (strip portions) 114*a*, 118*a* at the both ends in its lateral direction. In this case, the holding sheets 114 and the front sheets 118 are also referred to as strip sheets. The strips 114*a*, 118*a* herein are features that correspond to the "split pieces" according to this invention. The strips 114*a*, 118*a* having such construction are provided with a highly effective cleaning function which can easily trap dust or scrape dust out of a depression. Further, the strips 114*a*, 118*a* may have the same kind or different kinds of shape appropriately selected from various shapes, such as zigzag, linear and curved shapes. In this embodiment, each of the strips 114*a*, 118*a* extends in the longitudinal direction of the split cleaning parts 124 (in a direction transverse to the extending direction of the holding element 142).

The construction of a nonwoven fabric forming the above-described base sheet 113, holding sheet 114 and front sheet 118 and the construction of the fiber assembly 117 are now explained in detail.

(Construction of Nonwoven Fabric)

The base sheet 113, the holding sheet 114 and the front sheet 118 can typically be formed of sheet-like nonwoven fabric comprising thermal melting fibers (thermoplastic fibers) and thus referred to as the "nonwoven fabric sheet". The base sheet 113, the holding sheet 114 and the front sheet 118 herein form the "nonwoven fabric sheet" according to this invention. The nonwoven fabric has a sheet-like configuration formed by fixing or intertwining fibers by mechanical, chemical or heat treatment. The nonwoven fabric partly includes thermoplastic fibers and thus can be fusion bonded. Further, the nonwoven fabric has a plurality of strips. Examples of the thermal melting fibers (thermoplastic fibers) include polyethylene, polypropylene and polyethylene terephthalate.

Further, the nonwoven fabric preferably comprises thermoplastic fibers having practical strength of 10 to 100 g/m$^2$. The nonwoven fabric may be manufactured by through-air bonding, spun bonding, thermal bonding, spun lacing, point bonding, melt blowing, stitch bonding, chemical bonding, needle punching or other similar processes. This nonwoven fabric is a feature that corresponds to the "nonwoven fabric" according to this invention. In order to enhance the dust wiping function, it is preferred to use a nonwoven fabric having higher rigidity. Further, as an alternative to or in addition to the nonwoven fabric, strips made of urethane, sponge, woven fabric, net, split cloth or other similar materials may be used.

(Construction of Fiber Assembly)

The fiber assembly 117 is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 117 partially includes thermoplastic fibers and can be fusion bonded. The fibers forming the fiber assembly 117 are elements of yarn, textile or the like and defined as being thin and flexible fibers having a substantially longer length compared with the thickness. Typically, a long continuous fiber is defined as a filament and a short fiber as a staple Like the strips 114*a* and 118*a* of the holding sheet 114 and the front sheet 118, the fibers of the fiber assembly 117 extend in elongate shape in a direction transverse to the extending direction of the holding element 142. The fiber assembly 117 is also referred to as the "fiber bundle" having a plurality of fibers in a bundle. The fiber assembly 117 herein is a feature that corresponds to the "fiber assembly" according to this invention.

Further, in this embodiment, three fiber assemblies 117 are stacked in layers, but one or more layers of fiber assemblies may be used as necessary. Preferably, the fiber assembly 117 has a planar structure having a predetermined flat or curved surface and has a three-dimensional form having a certain thickness or has a thin sheet-like form. The "fiber assembly" is typically formed of polyethylene (PE), polypropylene (PP), polyethylene terephthalate (PET), nylon, rayon or the like. In practical use, an assembly of filaments formed by opening a tow is frequently used as the fiber assembly. It is particularly preferable that the fiber assembly comprises conjugated fibers having a core of polypropylene (PP) or polyethylene terephthalate (PET) and a core covering sheath of polyethylene (PE). Further, the filaments of the fiber assembly are preferred to have a fineness of 0.5 to 66 dtex. The individual fiber assembly may contain fibers of substantially the same fineness, or it may contain fibers of different finenesses. When using fibers containing thermoplastic resin, it is preferred to use at least two or more kinds of resins having different melting points (for example, resins between which the difference in the melting point is 20° C. or more).

Further, in order to enhance the dust wiping function, it is preferred to use a fiber assembly including fibers having higher rigidity or fibers having higher fineness. It is further preferred that the fiber assembly has crimped fibers. In this case, it is preferred to use crimped fibers having 5 to 30 crimps per inch. Here, the crimped fibers are fibers subjected to a predetermined crimping process and easily intertwined with each other. With the fibers being crimped, the fiber assembly becomes bulkier than before the holder is attached thereto, and dust can be easily captured by the crimped portions. This structure can be realized especially by using crimped fibers opened from a tow. Further, in order to reliably adsorb dirt, dust or the like, it is preferred to use fibers containing dust adsorbent oil.

For the fiber assembly, flat yarns or split yarns may also be used. The flat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a nonwoven fabric which is bulky and has low fiber density, such as a through-air bonded nonwoven fabric, may be used to form the fiber assembly.

The kinds and numbers of the component parts of the cleaning element 110 are not limited to those described in the above-described example, and can be selected as necessary.

Figure 8:
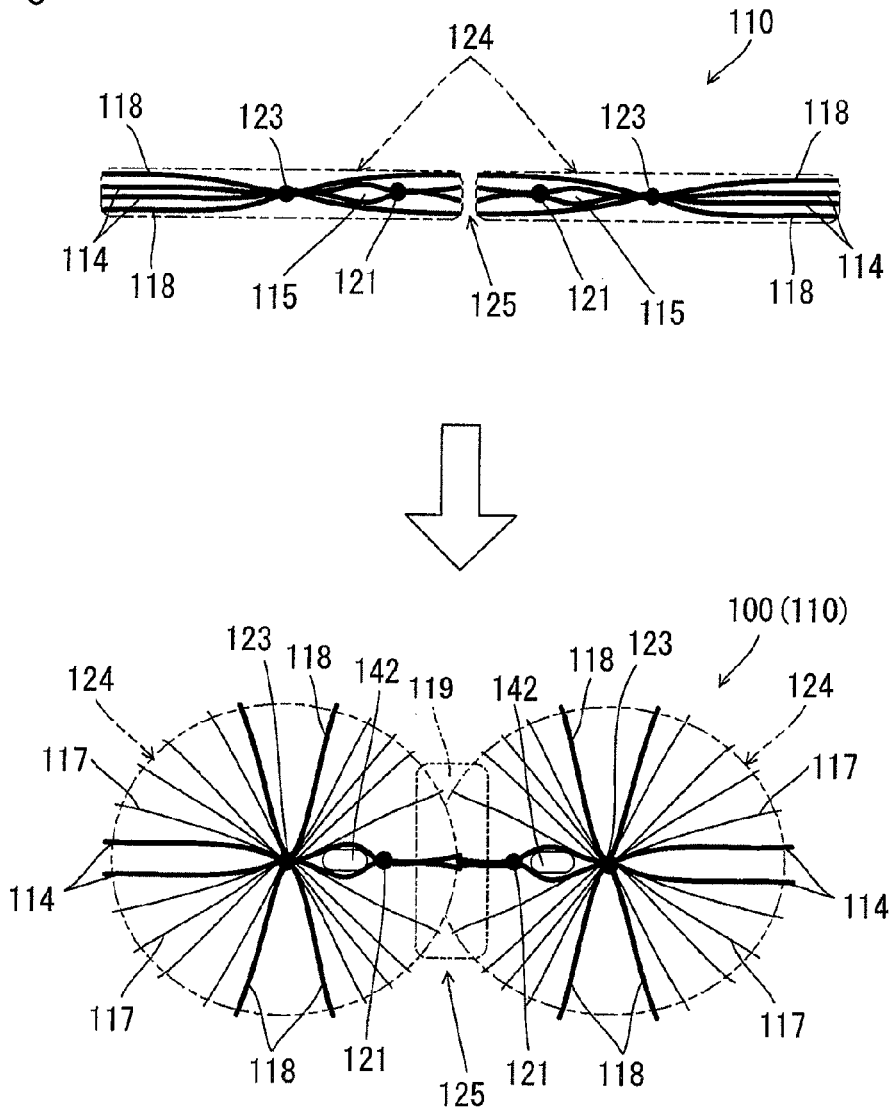
FIG. 8 is a sectional view of the cleaning element 110, taken along line A-A in FIG. 1 and schematically showing the states before and after attachment of the cleaning element holder.
Figure 9:
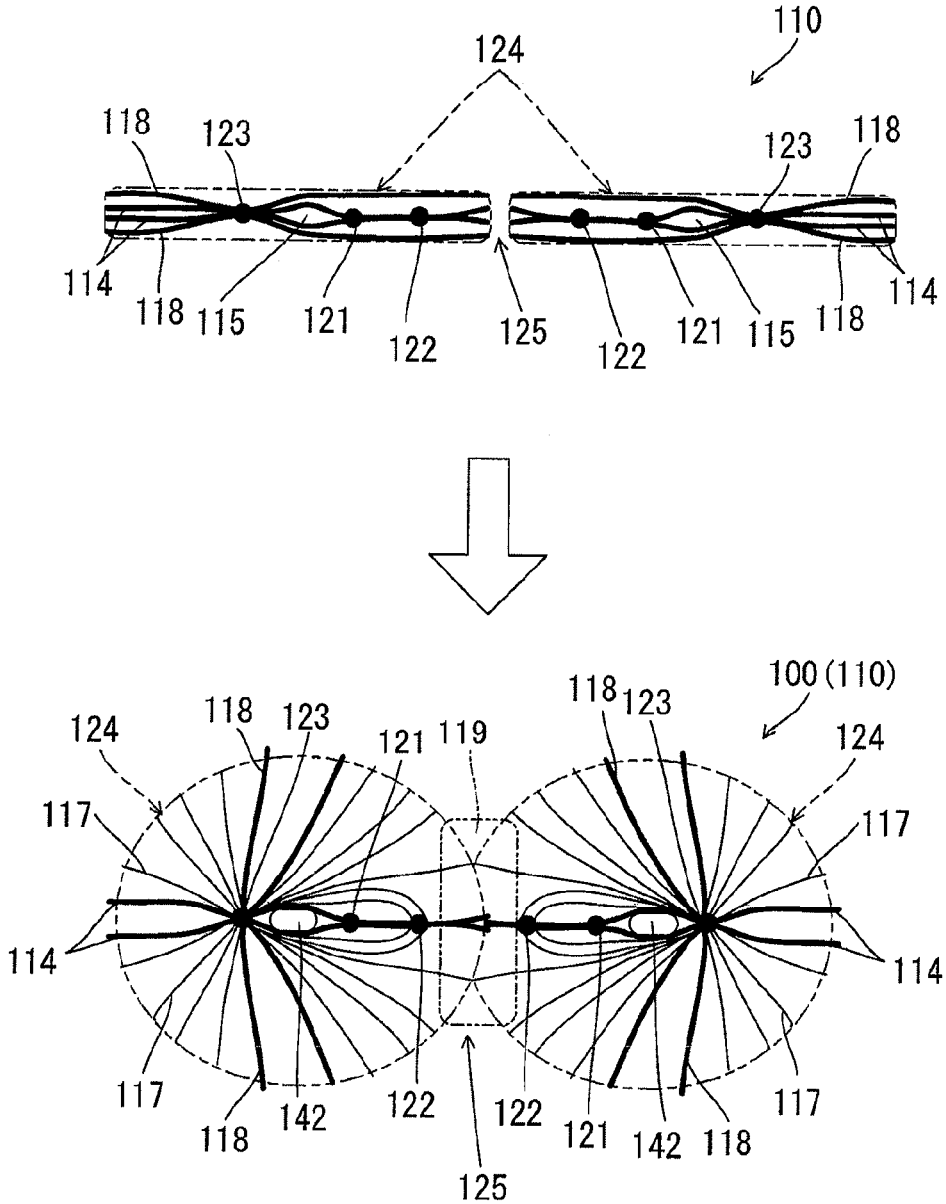
FIG. 9 is a sectional view of the cleaning element 110, taken along line B-B in FIG. 1 and schematically showing the state before and after attachment of the cleaning element holder.
Figure 10:
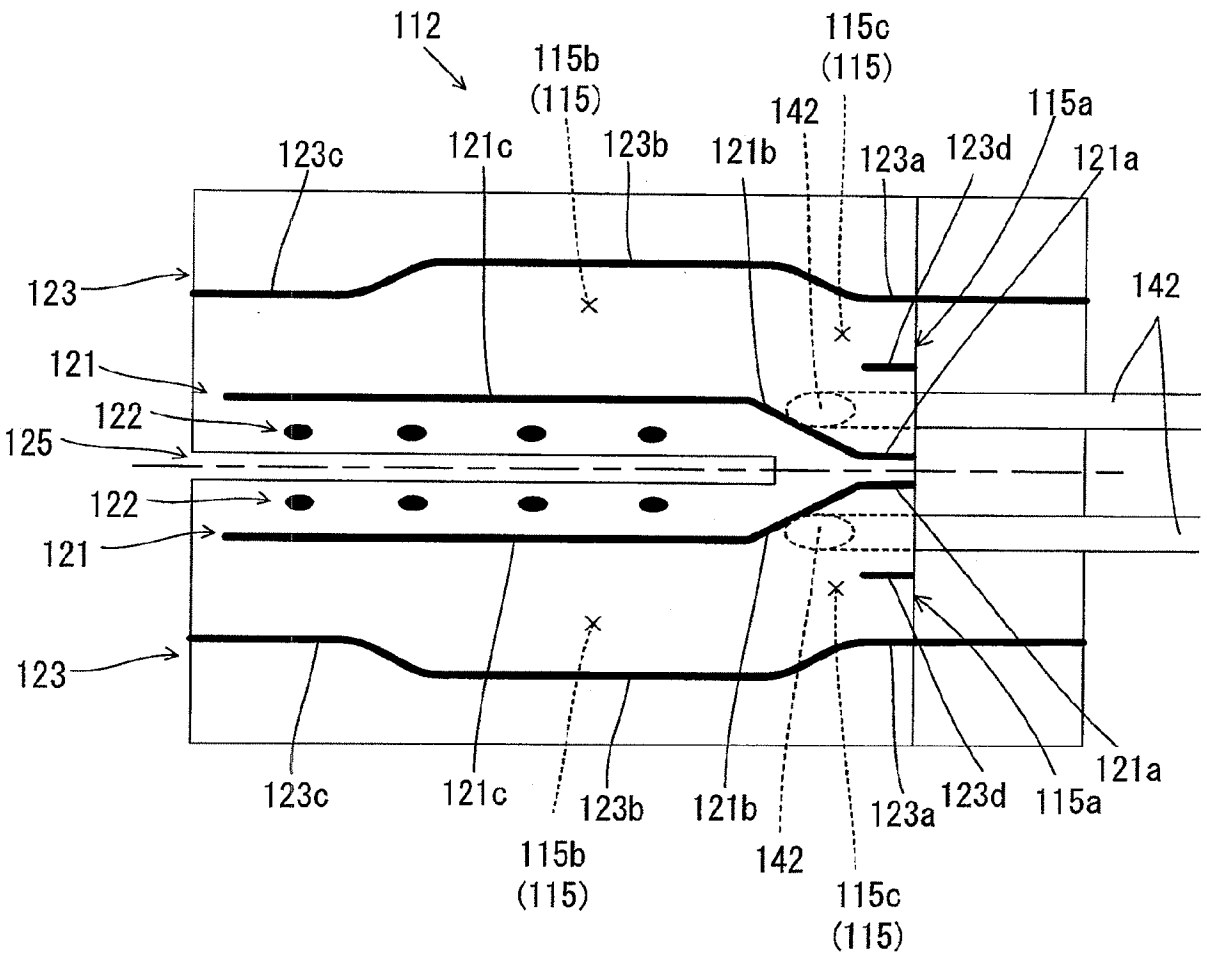
FIG. 10 is a plan view of the cleaning element 110 with the cleaning element holder 130.

The state of the cleaning tool 100 constructed as described above in which the cleaning element 110 and the cleaning element holder 130 are attached to each other is explained with reference to FIGS. 8 to 10. FIG. 8 is a sectional view of the cleaning element 110, taken along line A-A in FIG. 1 and schematically showing its states before and after attachment of the cleaning element holder. FIG. 9 is a sectional view of the cleaning element 110, taken along line B-B in FIG. 1 and schematically showing its states before and after attachment of the cleaning element holder. Further, FIG. 10 is a plan view of the cleaning element 110 with the cleaning element holder 130 attached thereto.

As shown in FIGS. 8 and 9, the distance L1 between the right and left insert holes 115 of the cleaning element 110 which is not yet attached to the cleaning element holder is designed to be longer than the distance L3 between the pair holding elements 142. On the other hand, when the pair holding elements 142 are inserted into the right and left insert holes 115, the right and left split cleaning parts 123 are deformed toward each other according to the distance L3 between the pair holding elements 142. As a result, after attachment of the cleaning element holder, the overlap region 119 is formed in the space 125 between the right and left split cleaning parts 123 facing each other, by surface contact, overlapping or intertwining of the holding sheets 114, the fiber assemblies 117 and the front sheets 118.

With such construction, a shape-retaining function is provided at least by overlapping of the fiber assemblies 117 between the adjacent split cleaning parts 124. As a result, the entire cleaning element 110 can be prevented from drooping, and unnecessary clearance can be prevented from being formed in the space 125. Further, the contact area between the object to be cleaned and the split cleaning parts 124 can be increased by wrapping the object to be cleaned between the split cleaning parts 124. Thus, the effect of cleaning the object to be cleaned which is inserted into the space 125 can be enhanced. Further, deterioration of the appearance of the cleaning tool 100 which may be caused by unnecessary clearance formed in the space 125 can be prevented. As a result, users can be convinced that the cleaning element 110 has a high cleaning effect and the user's cleaning motivation can be effectively enhanced.

Further, the split cleaning parts 124 of the cleaning element 110 are rectangular in section at the time of purchase or in the initial unused state. In use for actual cleaning operation, preferably, each of the split cleaning parts 124 is loosened or fluffed by the user such that its volume is increased. This loosening operation may be performed before or at the time of attachment of the cleaning element holder 130 to the cleaning element 110, or it may be performed after attachment of the cleaning element holder 130 to the cleaning element 110.

In this embodiment, the holding sheets 114, the fiber assemblies 117 and the front sheets 118 of the respective split cleaning parts 124 have the same length in a direction transverse to the longitudinal direction of the split cleaning parts 124 (in a direction transverse to the extending direction of the holding element 142) from a predetermined bonded part, or particularly the third bonded part 123. Therefore, when the user performs the loosening operation of the split cleaning parts 124, as shown in FIGS. 8 and 9, each of the split cleaning parts 123 becomes bulky into a generally circular or elliptical shape as viewed in section in a direction transverse to the extending direction of the holding element 142. In this bulky state, the strips 114*a* and 118*a* of the holding sheet 114 and front sheet 118 and the fibers of the fiber assemblies 117 radiate out from the third bonded part 123, as viewed in section in the direction transverse to the longitudinal direction of the split cleaning parts 124 (the direction transverse to the extending direction of the holding element 142). Further, in the state in which the two holding elements 142 are inserted into the right and left insert holes 115, the pair of right and left split cleaning parts 124 are deformed toward each other according to the distance between the pair holding elements 142 and form the overlap region 119 by surface contact, overlapping or intertwining of the holding sheets 114, the fiber assemblies 117 and the front sheets 118.

Further, as shown in FIG. 9, in a region of each cleaning element sheet part 116 of the split cleaning parts 124 which faces the space 125, a part of the fiber assemblies 117 of the cleaning element sheet part 116 is bonded to the holding sheet part 112 by the second bonded part 122. Therefore, even if the object to be cleaned is inserted into the space 125 during cleaning operation, the fiber assemblies 117 are prevented from being excessively turned upward or downward.

Figure 11:
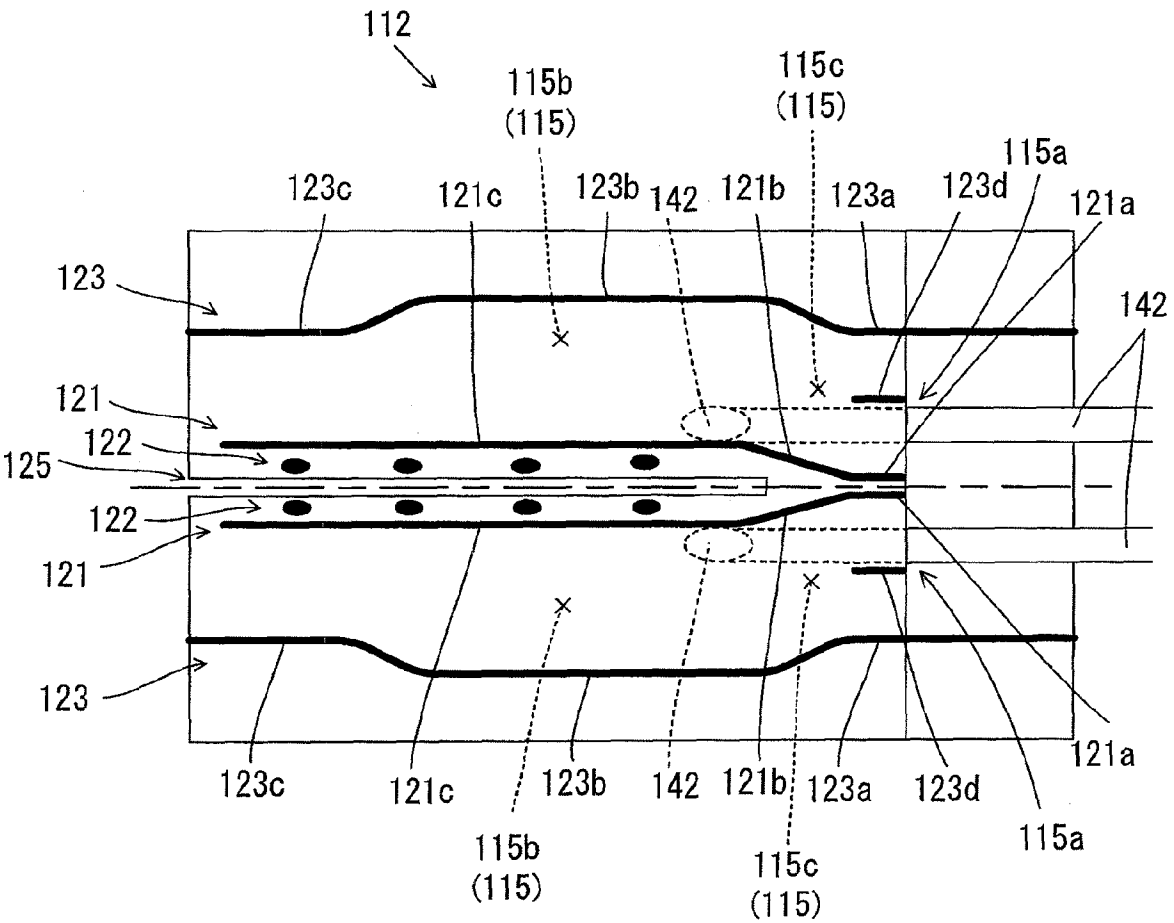
FIG. 11 is a plan view showing the holding sheet part 112 of the cleaning element 110 according to this embodiment, in a state in which the holding elements 142 are further inserted from the initial state shown in FIG. 10.
Figure 12:
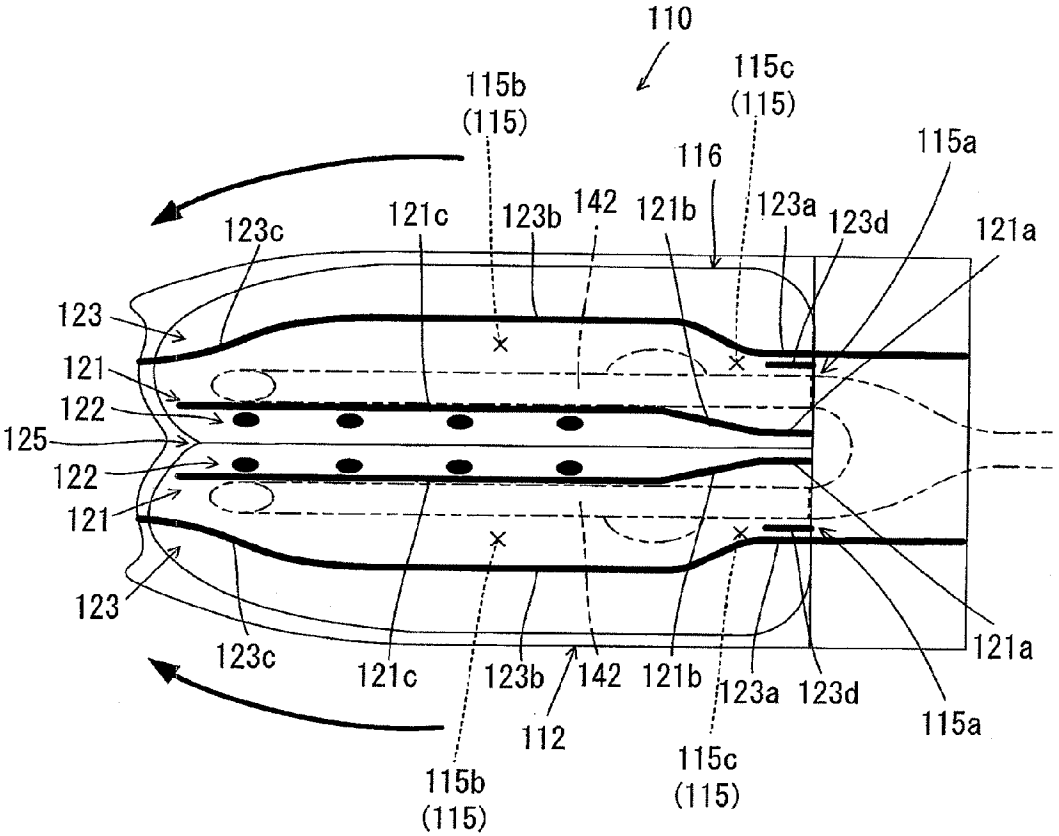
FIG. 12 is a perspective view showing the holding sheet part 112 of the cleaning element 110 according to this embodiment, in a state in which insertion of the holding elements 142 into the insert holes 115 is completed.

The state of the cleaning element 110 in the process of attachment of the cleaning element holder 130 is explained with reference to FIGS. 10 to 12. FIG. 10 is a plan view showing the holding sheet part 112 of the cleaning element 110 in this embodiment, in an initial state of insertion in which the front ends of the holding elements 142 are inserted into the insert holes 115. FIG. 11 is a plan view showing the holding sheet part 112 of the cleaning element 110 in this embodiment, in a state in which the holding elements 142 are further inserted into the insert holes 115 from the initial state shown in FIG. 10. FIG. 12 is a perspective view showing the holding sheet part 112 of the cleaning element 110 in this embodiment, in a state in which insertion of the holding elements 142 into the insert holes 115 is completed.

As shown in FIG. 10, in the initial state of insertion in which the holding elements 142 are inserted into the insert holes 115 through the openings 115*a*, the front end of each of the holding elements 142 firstly comes into contact with the bonding line 121*b* (inclined surface) of the first bonded part 121 according to the above-described dimensional configuration of the first bonded part 121. When the holding element 142 is further inserted into the insert hole 115, the holding element 142 is pressed against the inclined bonding line 121*b* of the first bonded part 121 in the second insert hole component 115*c*, so that the insert holes 115 are moved toward each other. At this time, the holding element 142 can be smoothly slid along the first bonded part 121 due to the inclination of the bonding line 121*b*.

Subsequently, as shown in FIG. 11, when each of the holding elements 142 is inserted into a region of the insert hole 115 (the first insert hole component 115*b*) in which the bonding line 121*c* of the first bonded part 121 is formed, the insert holes 115 are pressed toward each other such that the distance between the bonding lines 121*c* is shortened substantially to the distance between the holding elements 142. The bonding line 121*b* of the first bonded part 121 serves to guide the holding element 142 into the region of the insert hole 115 in which the bonding line 121*c* is formed, and at this time, allows easy insertion of the holding element 142.

Then, as shown in FIG. 12, when insertion of the holding elements 142 into the insert holes 115 is completed, the cleaning element 110 has a width reduced toward the front end of the cleaning element in a direction transverse to the longitudinal direction of the split cleaning parts 124 (the longitudinal direction of the cleaning element). With this construction, particularly, an operation of cleaning complicated areas by using the front end region of the cleaning element 110 or a cleaning operation by inserting the entire cleaning element 110 into a small clearance can be realized. Further, as described above, a contiguous contour of the third bonded part 123 which is formed by the bonding lines 123*a*, 123*b*, 123*c* is formed in a gentle curve bulged outward (to the side opposite the space 125) as a whole as shown by arrows in FIG. 12, so that the cleaning element has a rounded shape as a whole. Such a cleaning element makes a soft impression on the users, and the users are emotionally convinced that the shape of the cleaning element is suitable for cleaning operation or ensures an easy cleaning operation.

Further, as described above, with the construction in which the third bonded part 123 includes the three bonding lines 123*a* to 123*c* which extend in different positions in a direction transverse to the longitudinal direction of the split cleaning parts 124, the fiber length or amount of the fiber assemblies (the brush portion) in the inner portion of each of the split cleaning parts 124 is smaller in the front of the cleaning element in which the bonding line 123*c* is formed than in the middle of the cleaning element in which the bonding line 123*b* is formed. As a result, in a cleaning operation in which the object to be cleaned is caught in the space 125, fibers in the front of the cleaning element are prevented from excessively interfering with the object to be cleaned, and the object to be cleaned can be smoothly caught in the space.

Further, with the construction in which the third bonded part 123 includes the three bonding lines 123*a* to 123*c* which extend in different positions in the direction transverse to the longitudinal direction of the split cleaning part 124, the fiber length or amount of the fiber assemblies (the brush portion) in the outer portion of the split cleaning part 124 of the cleaning element is larger in the front of the cleaning element in which the bonding line 123*c* is formed than in the middle of the cleaning element in which the bonding line 123*b* is formed. As a result, in a cleaning operation in which the surface of the cleaning element 110 is used to clean the object to be cleaned, fibers in the front of the cleaning element comes in soft contact with the object to be cleaned.

Other Embodiments

Further, the invention is not limited to the above-described embodiment, but rather, may be added to, changed, replaced with alternatives or otherwise modified. For example, the following embodiments can also be performed in application of the above-described embodiment.

Figure 13:
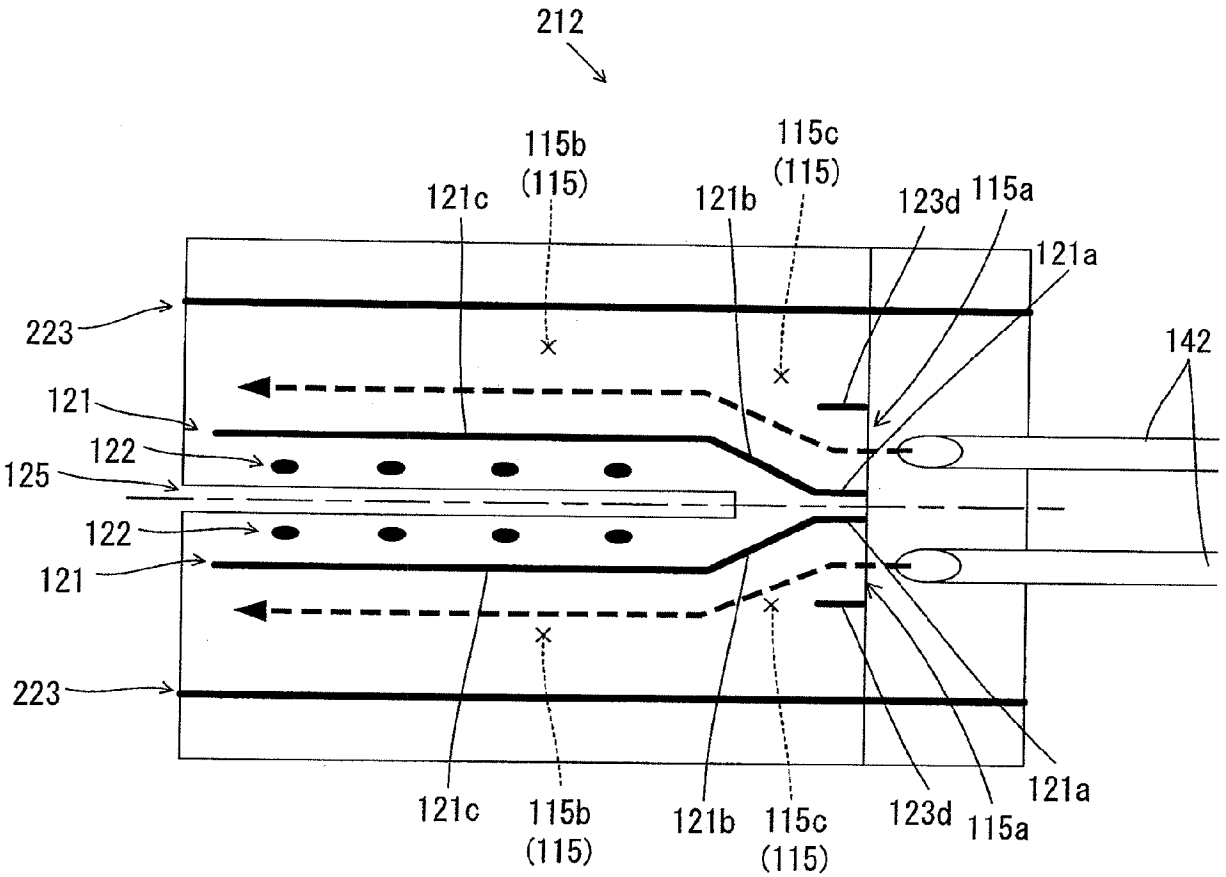
FIG. 13 is a plan view of a holding sheet part 212 having a third bonded part 223 of another embodiment.
Figure 14:
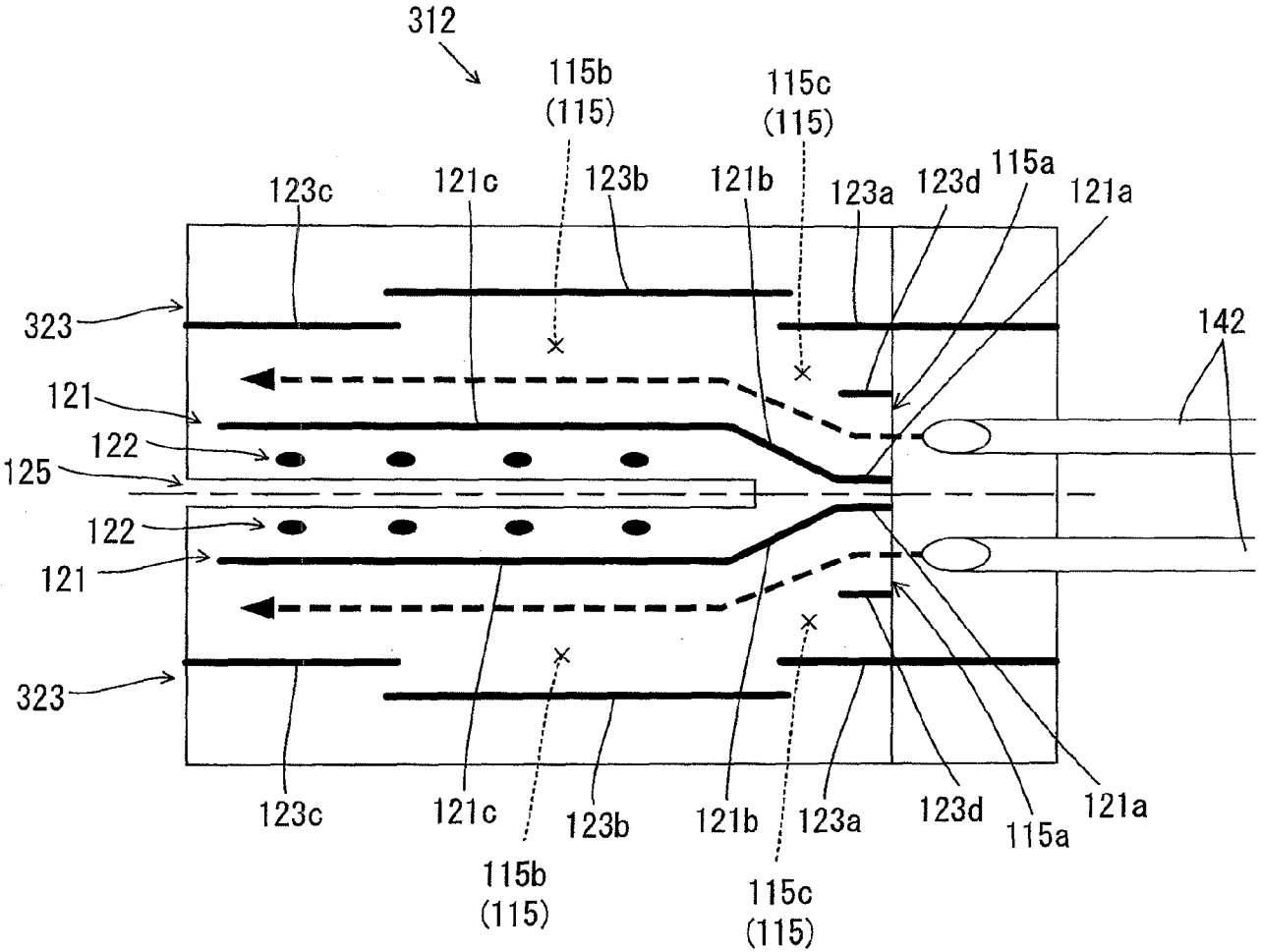
FIG. 14 is a plan view of a holding sheet part 312 having a third bonded part 323 of another embodiment.

In the above-described embodiment, the shape or arrangement of the third bonded part 123 in the holding sheet part 112 can be appropriately changed as necessary, for example, according to design specifications of the cleaning element 110. Referring to FIGS. 13 and 14, other embodiments of the third bonded part are described. FIG. 13 is a plan view of a holding sheet part 212 having a third bonded part 223 of another embodiment and FIG. 14 is a plan view of a holding sheet part 312 having a third bonded part 323 of another embodiment.

In the holding sheet part 212 shown in FIG. 13, unlike the holding sheet part 112 in FIG. 4, a single third bonded part 223 which extends straight in the longitudinal direction of the split cleaning part 124 is provided in each of the split cleaning parts 124. Further, in the holding sheet part 312 shown in FIG. 14, unlike the holding sheet part 112 in FIG. 4, the third bonded part 323 having the bonding lines 123*a*, 123*b*, 123*c* separated from each other by non-bonded parts is provided in each of the split cleaning parts 124. The constructions using the holding sheet parts 212, 312 having the third bonded parts 223, 323 also have the same effect as the construction using the holding sheet part 112 having the third bonded part 123. Further, the bonding lines 123*a*, 123*b*, 123*c* which form the third bonded part 223 or the third bonded part 323 may be designed not only to extend straight in the longitudinal direction of the split cleaning part 124, but to extend straight in a direction transverse to the longitudinal direction of the split cleaning part 124 or to extend in a curved line along the longitudinal direction of the split cleaning part 124.

Further, in the holding sheet part 112 in FIG. 4, a configuration in which the straight bonding line 123*b* is disposed inward of the straight bonding lines 123*a*, 123*c*, a configuration in which the straight bonding line 123*b* is disposed inward of the straight bonding line 123*a* and the straight bonding line 123*c* is disposed inward of the straight bonding line 123*b*, or a configuration in which the straight bonding line 123*b* is disposed outward of the straight bonding line 123*a* and the straight bonding line 123*c* is disposed outward of the straight bonding line 123*b* can also be used. Further, a bonded part corresponding to the third bonded part 123 may be formed only by one or two of the straight bonding lines 123*a* to 123*c*.

Further, in the above-described embodiment, the cleaning element 110 having the two split cleaning parts 124 is described, but in the invention, the number of parts corresponding to the split cleaning parts 124 which form the cleaning element 110 is not limited to two and may also be appropriately set to one or in the range of three or more.

Figure 15:
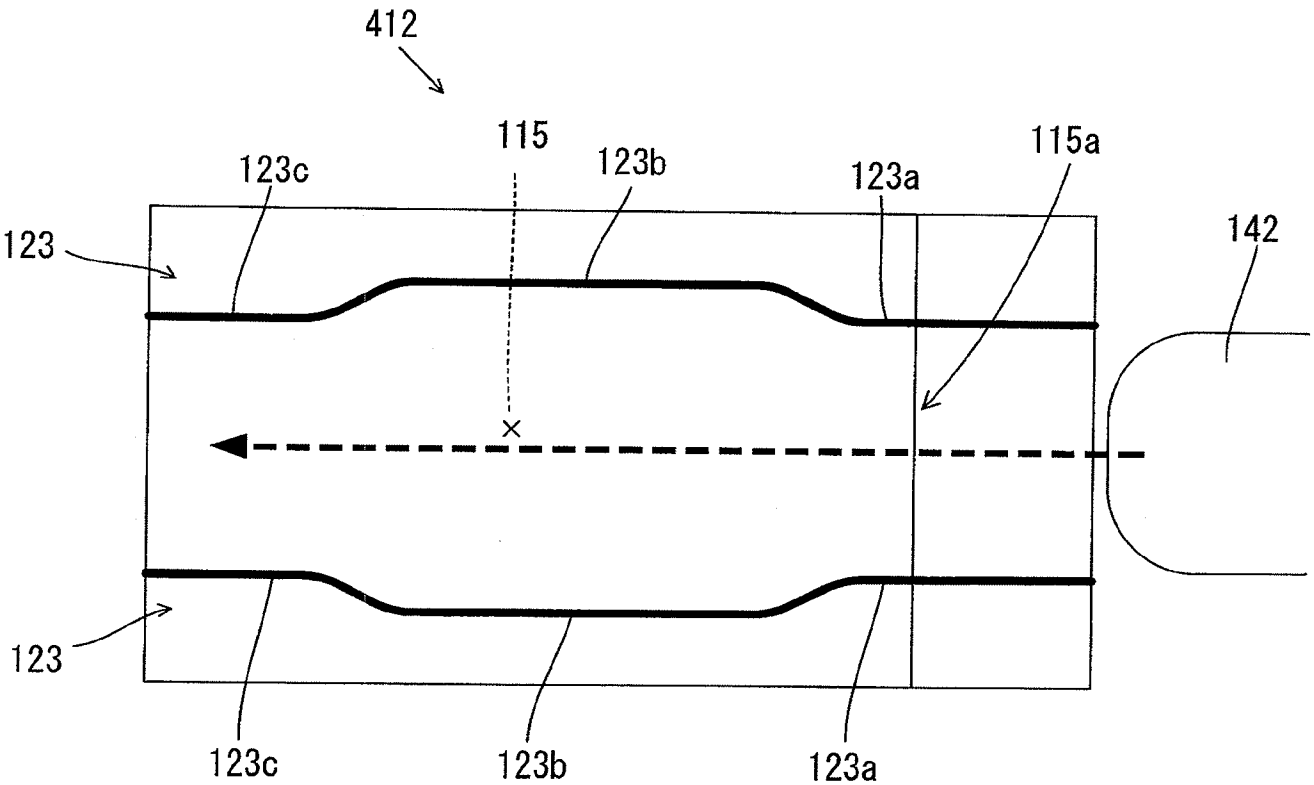
FIG. 15 is a plan view of a holding sheet part 412 of a further different embodiment.

Here, a structure in which only one part is provided corresponding to the split cleaning parts 124, or the cleaning element itself is not split is described with reference to FIG. 15. FIG. 15 is a plan view showing a holding sheet part 412 according to a further different embodiment.

In the holding sheet part 412 shown in FIG. 15, as the third bonded part 123 for bonding the holding sheet part (nonwoven fabric laminate) and the cleaning element sheet part (fiber assembly) which are overlaid one on the other, only a single bonding line formed by the bonding lines 123*a*, 123*b*, 123*c* in the holding sheet part 112 shown in FIG. 4 is used. In this holding sheet part 142, a pair of right and left third bonded parts 123 which define the both sides of a single insert hole 115 correspond to the "outer bonded part defining the outer side of the insert region in the direction transverse to the longitudinal direction of the cleaning element". Further, in this case, in place of the third bonded parts 123, the third bonded parts 223 as shown in FIG. 13 or the third bonded parts 323 as shown in FIG. 14 may also be adopted. Then in attachment of the cleaning element holder, the holding element 142 formed as a single piece is inserted into the insert hole 115 defined by the third bonded parts 123. In this construction, preferably, the sectional shape of the holding element 142 in the thickness direction of the holding sheet part 412 has a larger thickness in regions extending along the bonding lines 123*a*, 123*c* than in a region extending along the bonding line 123*b*.

Also in the holding sheet part 412 having such a construction, the length of the fiber assemblies extending outward from the third bonded part 123 in the cleaning element is longer in the rear of the cleaning element in which the bonding line 123*a* is formed and in the front of the cleaning element in which the bonding line 123*c* is formed than in the middle of the cleaning element in which the bonding line 123*b* is formed. On the other hand, the length of the fiber assemblies extending inward from the third bonded part 123 of each of the split cleaning parts 124 in the cleaning element is shorter in the rear of the cleaning element in which the bonding line 123*a* is formed and in the front of the cleaning element in which the bonding line 123*c* is formed than in the middle of the cleaning element in which the bonding line 123*b* is formed.

Further, in the above-described embodiment, the cleaning element 110 is described as being designed such that each of the split cleaning parts 124 has a generally circular or elliptical section, but in this invention, it is necessary for this section to form the generally circular or elliptical shape in its entirety or in part. For example, the section of the split cleaning part may also have a shape of one or more fans which forms part of a circular form.

Further, in the above-described embodiment, the cleaning element 110 is formed by a sheet-like nonwoven fabric and a fiber assembly, but in this invention, the cleaning element 110 may be formed by either one of the sheet-like nonwoven fabric and the fiber assembly.

Further, in the cleaning element 110 of the above-described embodiment, each of the cleaning sheet parts 116 has the front sheet 118, but the front sheet 118 can be omitted as necessary, for example, according to change of design specifications of the cleaning element 110.

The invention claimed is:

1. A cleaning tool to clean an object to be cleaned, said cleaning tool comprising:

an elongate cleaning element holder, a cleaning element that is attached to the cleaning element holder, wherein the cleaning element holder includes a grip and an elongate holding element extending from the grip, a fiber assembly provided in the cleaning element, wherein the fiber assembly is formed by a plurality of fibers extending in a direction transverse to a longitudinal direction of the cleaning element, a nonwoven fabric laminate provided in the cleaning element, wherein the nonwoven fabric laminate is formed by a plurality of nonwoven fabric sheets, a bonded part provided in the cleaning element to bond the fiber assembly and the nonwoven fabric laminate which are overlaid one on the other, an insert region provided in the cleaning element, wherein the insert region is defined by the plurality of nonwoven fabric sheets and the bonded part and receives the holding element, wherein the bonded part has an outer bonded part which defines an outer side of the insert region in a direction transverse to the longitudinal direction of the cleaning element, wherein the outer bonded part includes a plurality of bonded portions extending along the longitudinal direction of the cleaning element, the bonded portions being disposed in positions displaced from each other in a direction transverse to the longitudinal direction of the cleaning element, wherein the cleaning element holder has a plurality of the elongate holding elements extending side by side from the grip, wherein the cleaning element has a space which extends in the longitudinal direction of the cleaning element and into which the object to be cleaned is insertable, and wherein the cleaning element is split into a plurality of split cleaning parts by the space and each of the split cleaning parts has the bonded part and the insert region.

2. The cleaning tool according to claim 1, wherein the bonded portions of the outer bonded part include a first bonding line which is formed in a front end region of the cleaning element in which a front end of the holding element is placed when the cleaning element holder is attached to the cleaning element, the first bonding line extending straight in the longitudinal direction of the cleaning element, and a second bonding line which is formed rearward of the first bonding line in the cleaning element and extends straight in the longitudinal direction of the cleaning element, the first bonding line being disposed inward of the second bonding line.

3. The cleaning tool according to claim 2, wherein the bonded portions of the outer bonded part include a third bonding line which is formed rearward of the second bonding line in the cleaning element and extends straight in the longitudinal direction of the cleaning element, and the third bonding line is disposed inward of the second bonding line in the direction transverse to the longitudinal direction of the cleaning element.

4. The cleaning tool according to claim 3, wherein the first bonding line is connected to the second bonding line by a bonding line connected to the first and second bonding lines, and the third bonding line is connected to the second bonding line by another bonding line connected to the second and third bonding lines.

5. A cleaning element to clean an object to be cleaned, said cleaning element comprising:

a fiber assembly formed by a plurality of fibers extending in a direction transverse to a longitudinal direction of the cleaning element, a nonwoven fabric laminate formed by a plurality of nonwoven fabric sheets, a bonded part to bond the fiber assembly and the nonwoven fabric laminate which are overlaid one on the other, and an insert region which is defined by the plurality of nonwoven fabric sheets and the bonded part and configured to receive a holding element of a cleaning element holder, wherein the bonded part has an outer bonded part which defines an outer side of the insert region in the direction transverse to the longitudinal direction of the cleaning element, wherein the outer bonded part includes a plurality of bonded portions extending along the longitudinal direction of the cleaning element, the bonded portions are disposed in positions displaced from each other in the direction transverse to the longitudinal direction of the cleaning element, wherein the cleaning element has a space which extends in the longitudinal direction of the cleaning element and into which the object to be cleaned is insertable, and wherein the cleaning element is split into a plurality of split cleaning parts by the space and each of the split cleaning parts has the bonded part and the insert region.

6. The cleaning element according to claim 5, wherein the bonded portions of the outer bonded part include a first bonding line which is formed in a front end region of the cleaning element in which a front end of the holding element is placed when the cleaning element holder is attached to the cleaning element, the first bonding line extending straight in the longitudinal direction of the cleaning element, and a second bonding line which is formed rearward of the first bonding line in the cleaning element and extends straight in the longitudinal direction of the cleaning element, the first bonding line being disposed inward of the second bonding line.

7. The cleaning element according to claim 6, wherein the bonded portions of the outer bonded part include a third bonding line which is formed rearward of the second bonding line in the cleaning element and extends straight in the longitudinal direction of the cleaning element, and the third bonding line is disposed inward of the second bonding line in the direction transverse to the longitudinal direction of the cleaning element.

8. The cleaning element according to claim 7, wherein the first bonding line is connected to the second bonding line by a bonding line connected to the first and second bonding lines, and the third bonding line is connected to the second bonding line by another bonding line connected to the second and third bonding lines.

* * * * *